US010883718B2

(12) United States Patent
Lunel et al.

(10) Patent No.: US 10,883,718 B2
(45) Date of Patent: Jan. 5, 2021

(54) AIR INTAKE SWIRLER FOR A TURBOMACHINE INJECTION SYSTEM COMPRISING AN AERODYNAMIC DEFLECTOR AT ITS INLET

(71) Applicant: SAFRAN AIRCRAFT ENGINES, Paris (FR)

(72) Inventors: Romain Nicolas Lunel, Montereau sur le Jard (FR); Guillaume Aurelien Godel, Yerres (FR); Haris Musaefendic, Maisons-Alfort (FR); Christophe Pieussergues, Nangis (FR); Francois Pierre Georges Maurice Ribassin, Mennecy (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 47 days.

(21) Appl. No.: 16/095,813

(22) PCT Filed: Apr. 28, 2017

(86) PCT No.: PCT/FR2017/051017
§ 371 (c)(1),
(2) Date: Oct. 23, 2018

(87) PCT Pub. No.: WO2017/187104
PCT Pub. Date: Nov. 2, 2017

(65) Prior Publication Data

US 2020/0033007 A1 Jan. 30, 2020

(30) Foreign Application Priority Data

Apr. 28, 2016 (FR) ..... 16 53828

(51) Int. Cl.
*F23R 3/14* (2006.01)
*F23R 3/26* (2006.01)
*F23R 3/28* (2006.01)

(52) U.S. Cl.
CPC ..... *F23R 3/14* (2013.01); *F23R 3/26* (2013.01); *F23R 3/286* (2013.01)

(58) Field of Classification Search
CPC ..... F23R 3/12; F23R 3/14; F23R 3/26; F23R 3/28; F23R 3/286; F23R 3/30
See application file for complete search history.

(56) References Cited

U.S. PATENT DOCUMENTS 2,958,195 A * 11/1960 Dooley ..... F23R 3/14 60/748
3,648,457 A 3/1972 Bobo
(Continued)

FOREIGN PATENT DOCUMENTS

EP 0 678 708 A2 10/1995
EP 1 391 653 A2 2/2004
(Continued)

OTHER PUBLICATIONS

International Search Report dated Aug. 16, 2017, in PCT/FR2017/051017, filed Apr. 28, 2017.
(Continued)

*Primary Examiner* — William H Rodriguez
(74) *Attorney, Agent, or Firm* — Oblon, McClelland, Maier & Neustadt, L.L.P.

(57) ABSTRACT

An air intake swirler for a turbomachine injection system includes an upstream wall and a downstream wall, both of revolution about an axis of the air intake swirler, and fins distributed about the axis and connecting the upstream wall to the downstream wall so as to delimit, between the upstream wall and the downstream wall, air inlet channels
(Continued)

each having an inlet and an outlet. The swirler includes two aerodynamic deflectors that respectively extend the downstream walls radially outward and that have a concavity oriented upstream. The aerodynamic deflectors extend radially facing the respective inlets of the air inlet channels and thus make it possible to limit the loss of pressure of the air supplied to the air inlet channels.

12 Claims, 8 Drawing Sheets

(56) References Cited

U.S. PATENT DOCUMENTS

| | | | | |
|---|---|---|---|---|
| 3,915,387 | A * | 10/1975 | Caruel | F23R 3/14 239/400 |
| 3,937,011 | A * | 2/1976 | Caruel | F23D 11/107 60/737 |
| 3,946,552 | A * | 3/1976 | Weinstein | F23D 11/105 60/743 |
| 3,972,182 | A * | 8/1976 | Salvi | F23D 11/105 60/743 |
| 5,490,378 | A * | 2/1996 | Berger | F23C 7/00 60/39.23 |
| 5,737,921 | A | 4/1998 | Jones et al. | |
| 6,272,865 | B1 | 8/2001 | Clark et al. | |
| 6,550,251 | B1 * | 4/2003 | Stickles | F23R 3/14 239/403 |
| 2003/0196440 | A1 | 10/2003 | Steinthorsson et al. | |
| 2005/0097889 | A1 | 5/2005 | Pilatis et al. | |
| 2008/0202122 | A1 * | 8/2008 | Guezengar | F23R 3/002 60/722 |
| 2008/0289340 | A1 | 11/2008 | Oda et al. | |
| 2009/0255262 | A1 * | 10/2009 | McMasters | F23R 3/14 60/742 |
| 2011/0072825 | A1 | 3/2011 | Hicks et al. | |
| 2013/0020413 | A1 | 1/2013 | Jones et al. | |
| 2015/0052899 | A1 | 2/2015 | Toon | |
| 2016/0097537 | A1 * | 4/2016 | Wang | F23R 3/286 60/776 |
| 2016/0195274 | A1 | 7/2016 | Toon | |
| 2016/0363321 | A1 * | 12/2016 | Benjamin | F23R 3/343 |
| 2016/0377293 | A1 * | 12/2016 | Short | F23R 3/283 60/738 |

FOREIGN PATENT DOCUMENTS

| | | |
|---|---|---|
| EP | 1 959 197 A2 | 8/2008 |
| EP | 2 302 300 A2 | 3/2011 |
| EP | 2 549 183 A1 | 1/2013 |
| EP | 2 840 316 A1 | 2/2015 |
| EP | 2 944 792 A1 | 11/2015 |
| FR | 2 975 467 A1 | 11/2012 |

OTHER PUBLICATIONS

French Search Report dated Jan. 13, 2017, in FR 1653828, filed Apr. 28, 2016.

* cited by examiner

AIR INTAKE SWIRLER FOR A TURBOMACHINE INJECTION SYSTEM COMPRISING AN AERODYNAMIC DEFLECTOR AT ITS INLET

TECHNICAL FIELD

The present invention relates to an air intake swirler for being part of an air and fuel injection system in a turbomachine, as well as a turbomachine injection system comprising at least one such air intake swirler, and an aircraft turbomachine comprising such an injection system.

STATE OF PRIOR ART

The appended FIG. 1 illustrates an aircraft turbomachine 10 of a known type, for example a turbofan engine, generally including a fan 12 for sucking an airflow divided downstream of the fan into a primary flow supplying a core of the turbomachine and a secondary flow by-passing this core. The turbomachine core generally includes a low pressure compressor 14, a high pressure compressor 16, a combustion chamber 18, a high pressure turbine 20 and a low pressure turbine 22. The turbomachine is faired by a nacelle 24 surrounding the flow space 26 of the secondary flow. The turbomachine rotors are rotatably mounted about a longitudinal axis 28 of the turbomachine.

FIG. 2 represents the combustion chamber 18 of the turbomachine of FIG. 1. Conventionally, this combustion chamber, which is of the annular type, comprises two coaxial annular walls, respectively radially inner 32 and radially outer 34 walls, which extend from upstream to downstream, along the flow direction 36 of the gas primary flow in the turbomachine, about the axis of the combustion chamber which is identical to the axis 28 of the turbomachine. These inner 32 and outer 34 annular walls are connected to each other at their upstream end by a chamber bottom annular wall 40 which extends substantially radially about the axis 28. This chamber bottom annular wall 40 is equipped with injection systems 42 distributed about the axis 28 each to allow injection of an air and fuel mixture centred along a respective injection axis 44. Throughout this description, the axial and radial directions are defined with reference to the injection axis 44. In addition, a transverse plane is a plane orthogonal to the injection axis 44.

The combustion chamber generally includes a protective annular fairing 45 extending facing an upstream face of the chamber bottom wall 40 and including injector passage and air intake ports.

In use, a part 46 of an airflow 48 from a diffuser 49 and from the compressor 16 supplies the injection systems 42 whereas another part 50 of this airflow bypasses the combustion chamber by flowing downstream along the coaxial walls 32 and 34 of this chamber and allows in particular supply of air inlet ports provided within these walls 32 and 34.

As shown in FIG. 3, each injection system 42 generally includes a sleeve 52, sometimes called a "sliding through hole", in which a fuel injection nozzle 54 forming the end of an injector arm 55 is mounted, as well as one or more air intake swirlers 56, 58, and finally a bowl 60, sometimes called a "mixing bowl" or "pre-vaporisation bowl", which essentially takes the form of an annular wall having a downstream flared frustoconical part. These elements are centred relative to the injection axis 44.

The air intake swirlers 56, 58 are separated from each other by an annular wall which radially inwardly extends to form an inner deflection annular wall 62, also called "venturi", having an inner profile with a convergent-divergent shape.

The injection systems 42 have an essential role in the operation of the combustion chamber. Their efficiency depends in particular on the quality of their supply with air which directly comes from the diffuser.

In this regard, the air intake swirlers 56, 58 take part in mixing air and fuel. Each swirler 56, 58 thus includes an annular row of tilted fins so as to rotate the airflow 64 and thus improve atomisation of the fuel jet from the fuel injection nozzle 54. In particular, part of this fuel runs in liquid form on the inner surface of the venturi 62 and is sheared by the air swirling at the downstream end of the venturi 62.

DISCLOSURE OF THE INVENTION

The purpose of the invention is to improve the performance of turbomachine injection systems.

To that end, it provides an air intake swirler for a turbomachine injection system, comprising an upstream wall and a downstream wall both of revolution about an axis of the air intake swirler, and fins distributed about the axis and connecting the upstream wall to the downstream wall so as to delimit between the upstream and downstream walls air inlet channels each having an inlet arranged on a radially outer side and an outlet arranged on a radially inner side.

According to the invention, the air intake swirler further includes an aerodynamic deflector which is an outwardly radial extension of the downstream wall up to a free end of the aerodynamic deflector, and which has a concavity pointing upstream such that the aerodynamic deflector extends radially facing the respective inlets of the air inlet channels.

Generally, the aerodynamic deflector enables the airflow intended to enter the air inlet channels to be channelled and thus head losses of this airflow to be limited at best.

As a result, there is an improvement in the general performance of a turbomachine combustion chamber equipped with an injection system comprising such an air intake swirler, in particular in terms of overall thermodynamic cycle.

In a first preferred embodiment of the invention, the aerodynamic deflector continuously extends over 360 degrees about the axis, from the downstream wall to the free end of the aerodynamic deflector.

In a second preferred embodiment of the invention, the aerodynamic deflector includes recesses formed in the free end of the aerodynamic deflector so as to delimit between them teeth respectively arranged facing the respective inlets of the air inlet channels.

Preferably, the upstream and downstream walls extend substantially orthogonally to the axis.

Additionally, the aerodynamic deflector is preferably shaped such that at each point of the free end of the aerodynamic deflector, a circumferential plane tangent to a radially inner edge of the free end is substantially parallel to the axis of the air intake swirler.

The invention also relates to an injection system for injecting an air and fuel mixture into a turbomachine combustion chamber, comprising a sleeve for centring an injector, a bowl, and at least one first air intake swirler of the type described above which is axially arranged between the sleeve and the bowl.

Preferably, the injection system further comprises a second air intake swirler also of the type described above, axially arranged between the first air intake swirler and the bowl.

In this case, the downstream wall of the first air intake swirler is preferably the upstream wall of the second air intake swirler.

Moreover, the injection system advantageously comprises an inner deflection annular wall having an inner profile with a convergent-divergent shape, which is an extension of the downstream wall of the first air intake swirler inwardly of the injection system.

Preferably, the respective free ends of the respective aerodynamic deflectors of the first and second air intake swirlers substantially extend in a same transverse plane.

In this case, the upstream wall of the first air intake swirler extends in the same transverse plane.

Alternatively, the respective free ends of the respective aerodynamic deflectors of the first and second air intake swirlers can be offset with respect to each other along the direction of the axis of the air intake swirler.

In preferred embodiments of the invention, each of the respective aerodynamic deflectors of the first and second air intake swirlers is of revolution about the axis of the air intake swirler.

In other preferred embodiments of the invention, at least one of the respective aerodynamic deflectors of the first and second air intake swirlers is shaped such that the radial extent of the air inlet section of the corresponding air intake swirler varies about the axis of the air intake swirler.

The invention further relates to an aircraft turbomachine, comprising a combustion chamber and at least one injection system of the type described above to supply the combustion chamber with an air and fuel mixture.

BRIEF DESCRIPTION OF THE DRAWINGS

The invention will be better understood, and further details, advantages and characteristics thereof will appear upon reading the following description made by way of non-limiting example and in reference to the appended drawings in which.

Throughout these figures, identical references can designate identical or analogous elements.

DETAILED DISCLOSURE OF PREFERRED EMBODIMENTS

Figure 1:
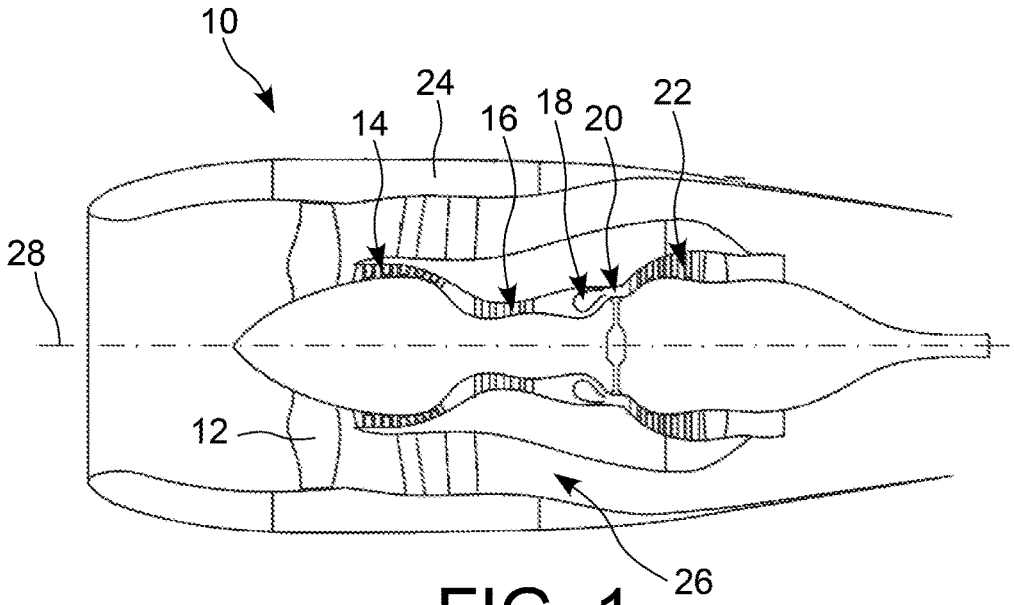
FIG. 1 Prior Art
FIG. 1, already described, is an axial cross-section schematic view of a turbomachine of a known type.
Figure 3:
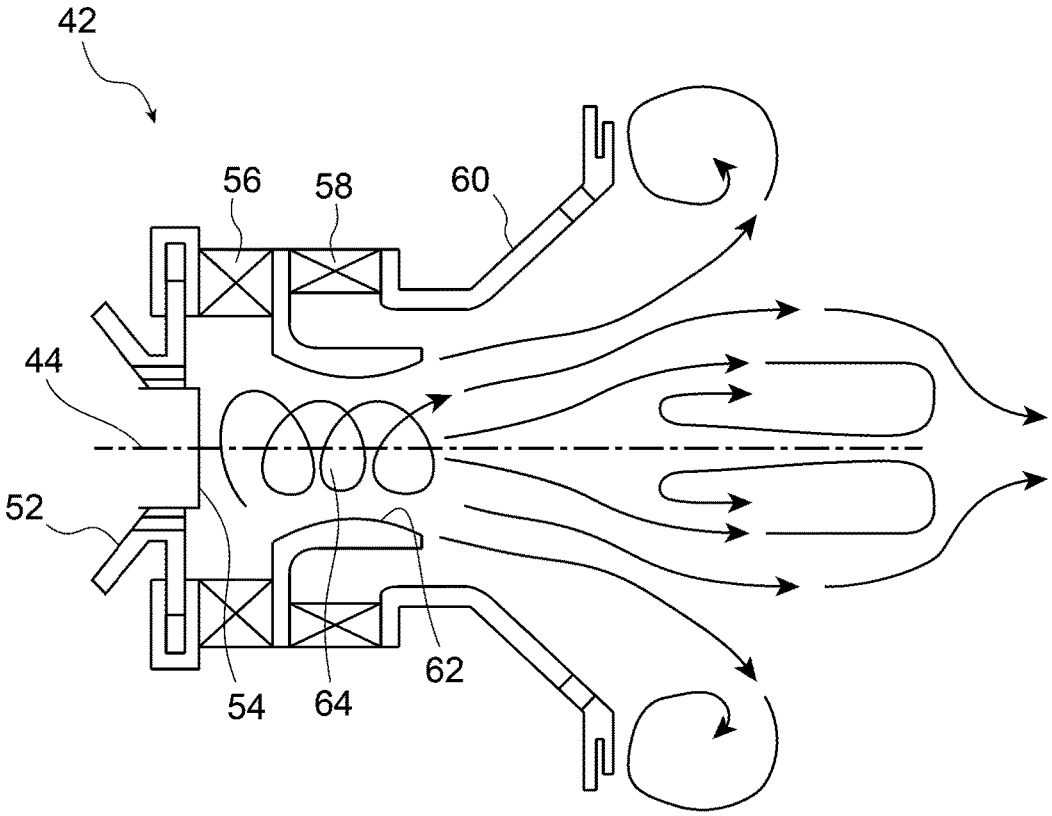
FIG. 3 Prior Art
FIG. 3, already described, is an axial cross-section schematic view of an injection system of the combustion chamber of FIG. 2.
Figure 2:
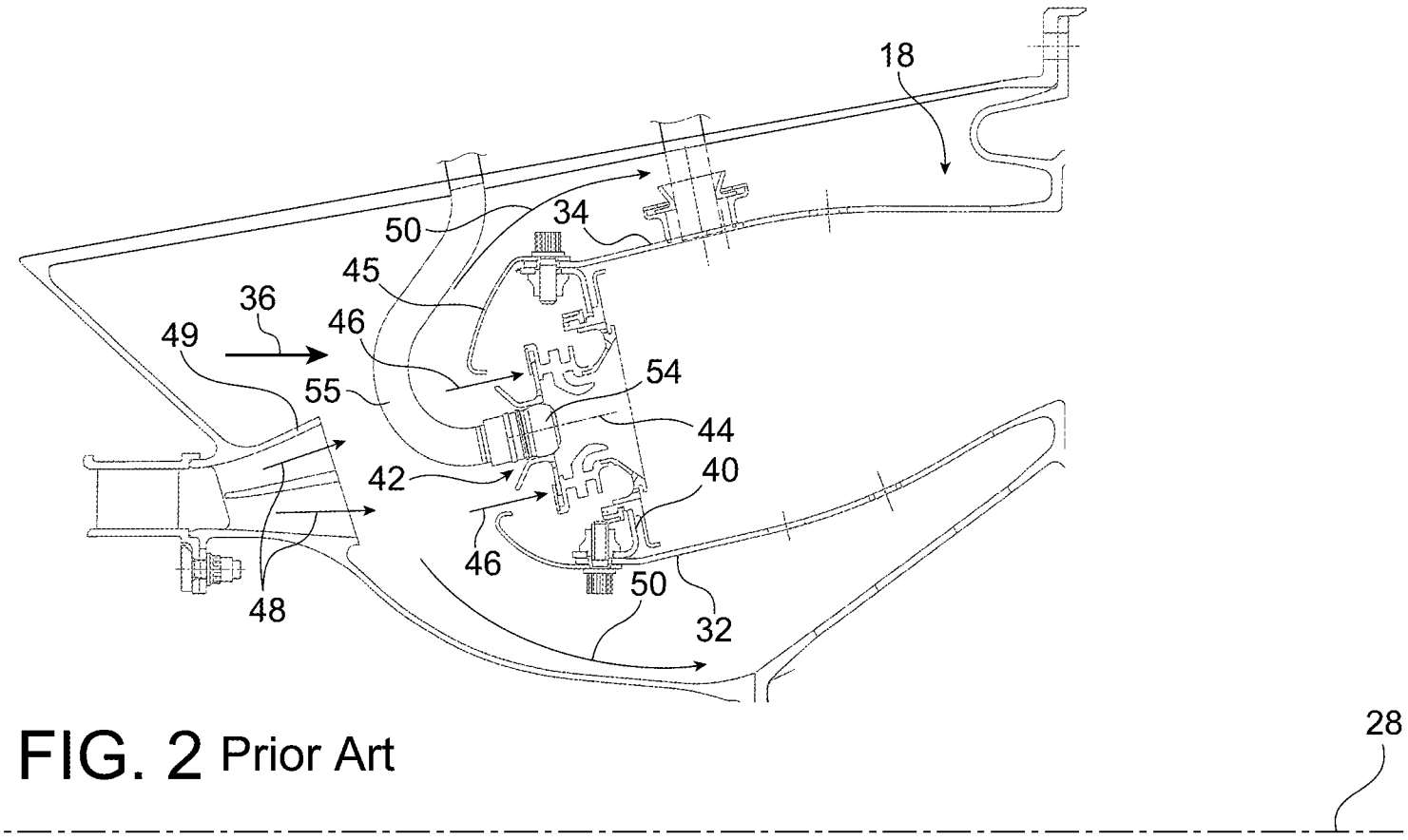
FIG. 2 Prior Art
FIG. 2, already described, is a half-axial cross-section schematic view of a combustion chamber of the turbomachine of FIG. 1.
Figure 4:
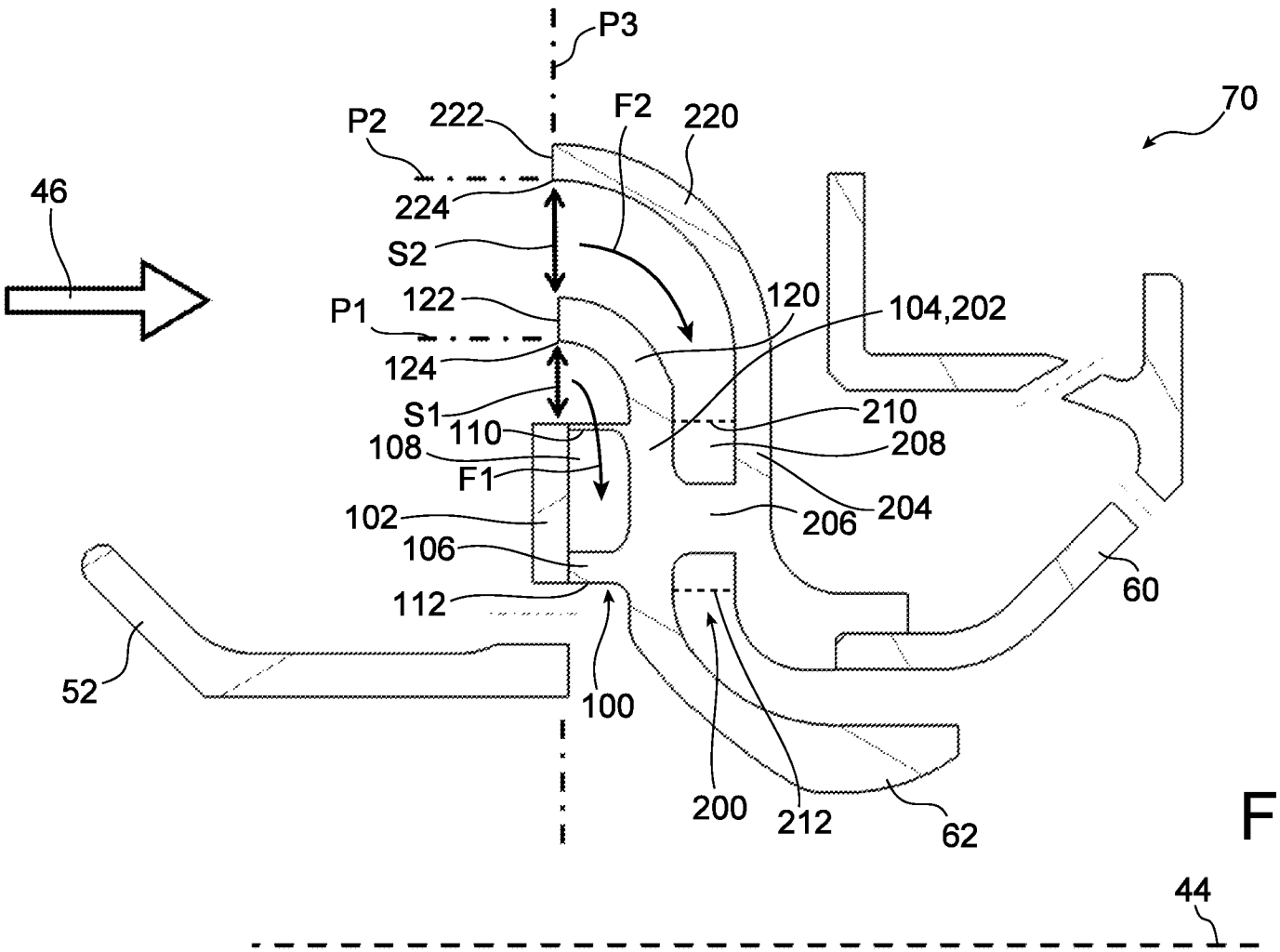
FIG. 4 is a half-axial cross-section schematic view of an injection system according to a first preferred embodiment of the invention.
Figure 5:
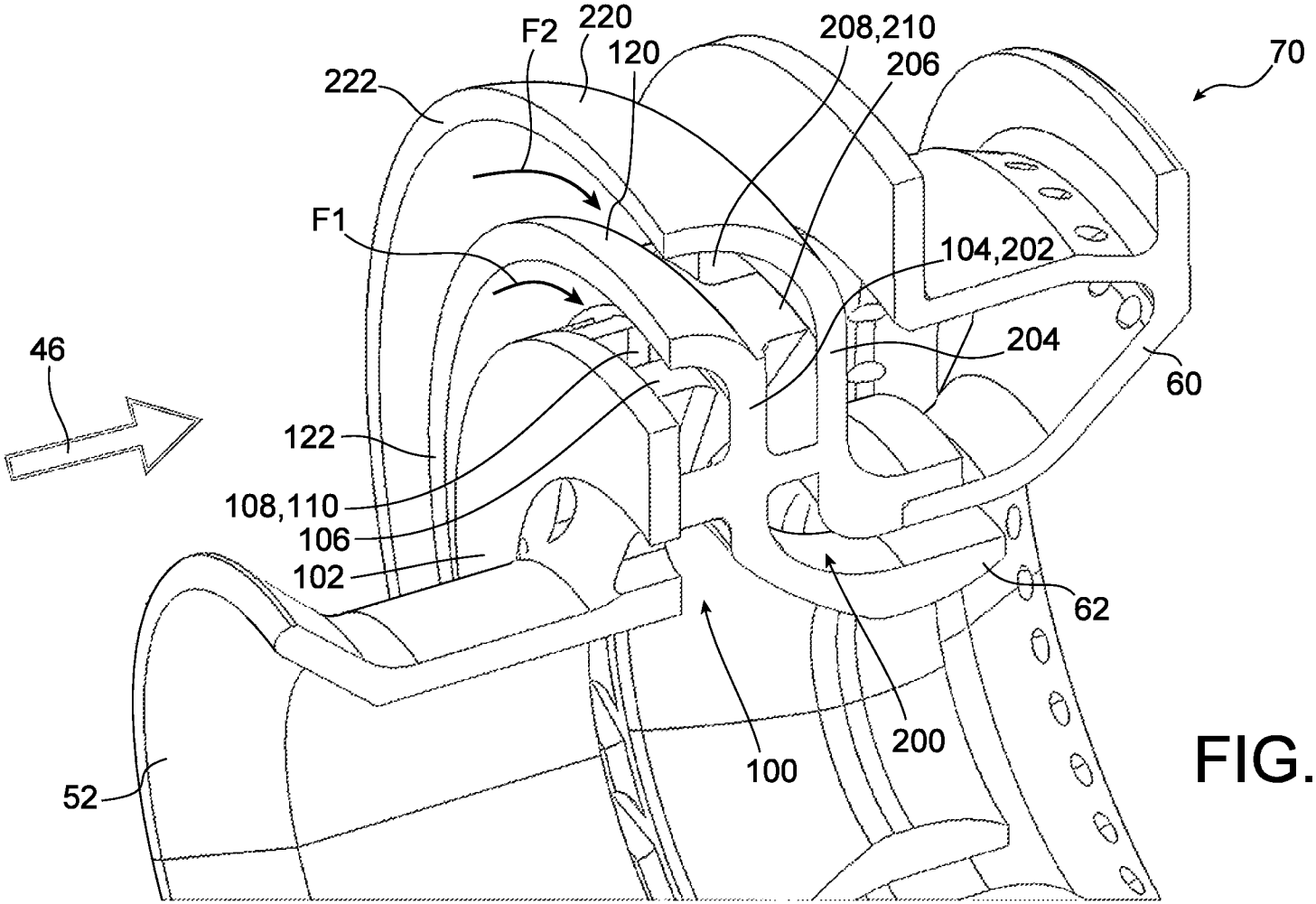
FIG. 5 is an axial cross-section perspective partial schematic view of the injection system of FIG. 4.

FIGS. 4 and 5 illustrate an injection system 70 similar to the injection system 42 of FIG. 2 described above but comprising two air intake swirlers 100, 200 which are both in accordance with a first preferred embodiment of the invention. The injection system 70 is for equipping an aircraft turbomachine of the same type as the turbomachine of FIG. 1 already described, or any other turbomachine type.

The injection system 70 thus comprises a sleeve 52 for receiving a fuel injection nozzle, the air intake swirlers 100, 200, and a bowl 60. The air intake swirlers 100, 200 are for injecting a swirling airflow in two inner annular spaces of the injection system which are separated from each other by an inner deflection annular wall 62 having an inner profile with a convergent-divergent shape, also called a "venturi", as explained above in connection with the injection system 42 of a known type.

The first air intake swirler 100, also called an "inner swirler", includes an upstream wall 102 and a downstream wall 104 which both are of revolution about an axis of the swirler which is identical to the injection axis 44 of the injection system. The first air intake swirler 100 further includes fins 106 distributed about the axis 44 and connecting the upstream wall 102 to the downstream wall 104 so as to delimit between the upstream and downstream walls air inlet channels 108. Each air inlet channel 108 has an inlet 110 arranged on a radially outer side and an outlet 112 arranged on a radially inner side. More precisely, each inlet 110 is delimited between respective radially outer ends of two consecutive fins 106 which delimit the corresponding air inlet channel 108. Analogously, each outlet 112 is delimited between respective radially inner ends of the two consecutive fins 106 which delimit the corresponding air inlet channel 108.

According to one feature of the invention, the first air intake swirler 100 further includes an aerodynamic deflector 120 which is an outwardly radial extension of the downstream wall 104 to a free end 122 of the aerodynamic deflector 120. The latter has a concavity pointing upstream. The aerodynamic deflector 120 thus extends radially facing the respective inlets 110 of the air inlet channels 108. The free end 122 of the aerodynamic deflector 120 is thus globally oriented towards upstream and delimits an air inlet section of the first air intake swirler 100.

Generally, the aerodynamic deflector 120 thus enables the airflow F1 entering the air inlet channels 108 to be channelled and thus head losses of this airflow to be limited at best.

In the first preferred embodiment of the invention illustrated in FIGS. 4 and 5, the aerodynamic deflector 120 continuously extends over 360 degrees about the axis 44, from the downstream wall 104 to the free end 122 of the aerodynamic deflector 120.

In the example illustrated, the upstream 102 and downstream 104 walls of the first air intake swirler 100 extend orthogonal to the axis 44. The swirler is thus of the radial type and thus has an optimum compactness along the axial direction.

Alternatively, the upstream 102 and downstream 104 walls can be tilted with respect to the axis 44, without departing from the scope of the invention.

Moreover, in the example illustrated, the aerodynamic deflector 120 has a curved shape from the downstream wall 104 to the free end 122.

The aerodynamic deflector 120 can be advantageously manufactured by an additive manufacturing method, for example of the selective laser melting (SLM) type.

Alternatively, the aerodynamic deflector 120 can have one or more curved axial sections and one or more cylindrical or frustoconical axial sections axially arranged end-to-end, without departing from the scope of the invention.

Further alternatively, the aerodynamic deflector 120 can consist of a succession of frustoconical shaped axial sections, having respective vertex angles all the smaller as the axial section being considered is far from the downstream wall 104. In other words, the aerodynamic deflector 120 can have a segmented curvature instead of a continuous curvature, without departing from the scope of the invention.

Additionally, in the example illustrated, the aerodynamic deflector 120 is shaped such that at each point of its free end 122, a circumferential plane P1 tangent to a radially inner edge 124 of the free end 122 is parallel to the axis 44 of the first air intake swirler 100.

Further, the aerodynamic deflector 120 is of revolution about the axis 44. The aerodynamic deflector 120 thus delimits an air inlet section of the first air intake swirler 100, with a constant radial extent S1 about the axis 44.

In preferred embodiments of the invention, the air inlet section of the first air intake swirler 100 is higher than or equal to the triple of the sum of the respective passage sections of the air inlet channels 108 of the first air intake swirler 100.

Alternatively, the aerodynamic deflector 120 can have an uneven shape about the axis 44 so as to adapt the radial extent S1 of the air inlet section to pressure unevennesses of the airflow 46 from the diffuser 49 of the turbomachine, as will be more clearly apparent in what follows.

The second air intake swirler 200, which is axially arranged between the first air intake swirler 100 and the bowl 60, has a configuration analogous to that of the first air intake swirler 100.

In particular, the second air intake swirler 200, also called an "outer swirler", includes an upstream wall 202, which is the downstream wall 104 of the first air intake swirler 100, and a downstream wall 204. Both walls 202, 204 are of revolution about the axis of the swirler 200 which is identical to the injection axis 44 of the injection system. The second air intake swirler 200 further includes fins 206 distributed about the axis 44 and connecting the upstream wall 202 to the downstream wall 204 so as to delimit between the upstream and downstream walls air inlet channels 208. Each air inlet channel 208 has an inlet 210 arranged on a radially outer side and an outlet 212 arranged on a radially inner side. More precisely, each inlet 210 is delimited between respective radially outer ends of the two consecutive fins 206 which delimit the corresponding air inlet channel 208. Analogously, each outlet 212 is delimited between respective radially inner ends of the two consecutive fins 206 which delimit the corresponding air inlet channel 208.

Moreover, the second air intake swirler 200 includes an aerodynamic deflector 220 which is an outwardly radial extension of the downstream wall 204 up to a free end 222 of the aerodynamic deflector 220 broadly oriented upstream and delimiting an air inlet section of the second air intake swirler 200.

The aerodynamic deflector 220 has analogous characteristics to those of the aerodynamic deflector 120 of the first air intake swirler 100 described above, and thus enables the airflow F2 entering the air inlet channels 208 to be channelled.

In particular, a circumferential plane P2 tangent to a radially inner edge 224 of the free end 222 is parallel to the axis 44 of the second air intake swirler 200 (FIG. 4).

In the illustrated example, the respective free ends 122, 222 of the respective aerodynamic deflectors 120, 220 of the first and second air intake swirlers 100, 200 substantially extend in a same transverse plane P3, in which the upstream wall 102 of the first air intake swirler 100 also extends. Thus, the air inlet sections respectively delimited by the aerodynamic deflectors 120 and 220 are substantially defined in the transverse plane P3.

On the other hand, the inner deflection annular wall 62 extends as an extension of the downstream wall 104 of the first air intake swirler 100 inwardly of the injection system 70.

Figure 6:
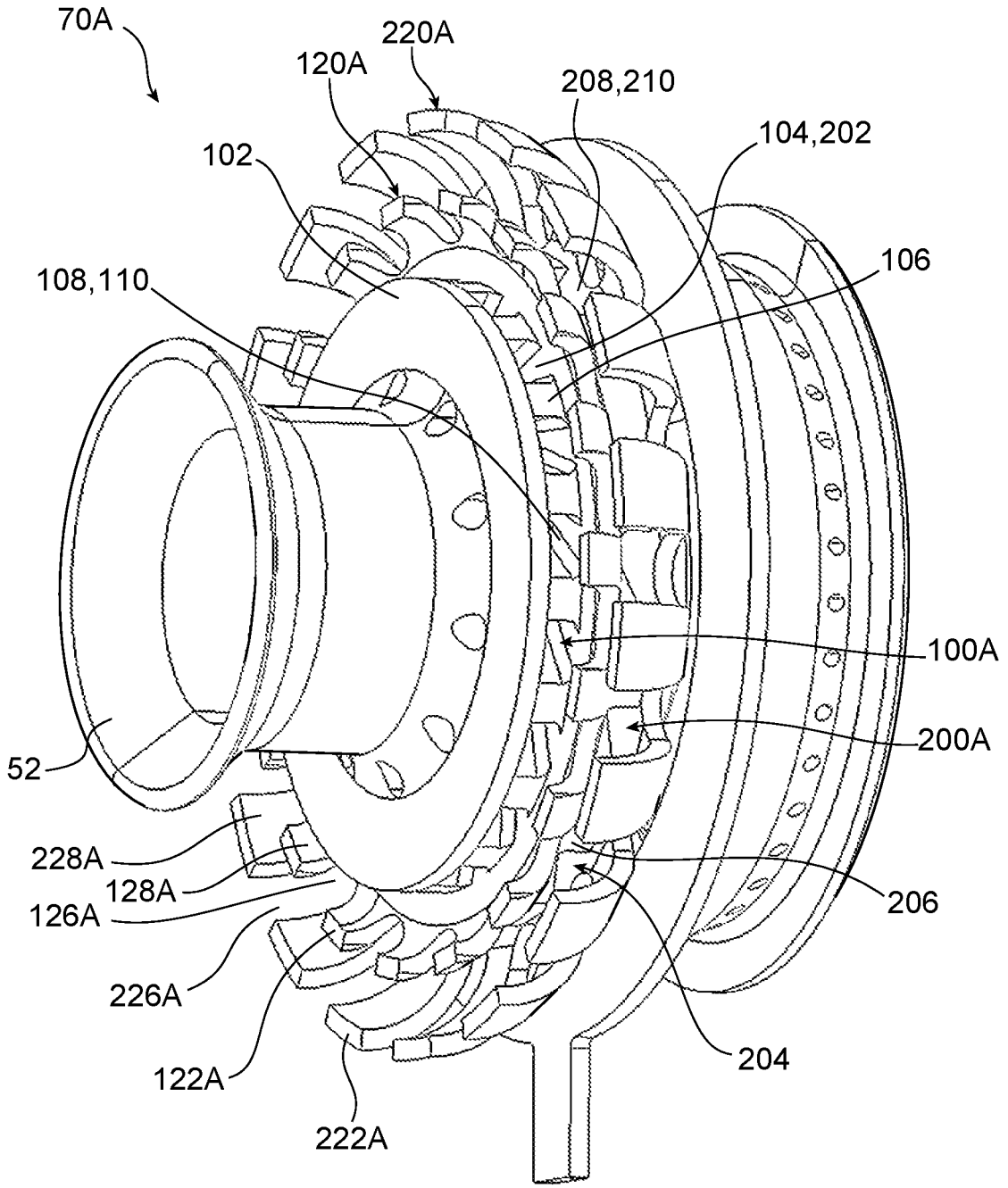
FIGS. 6 and 7 are schematic views, respectively a perspective and a front view, of an injection system according to a second preferred embodiment of the invention.
Figure 7:
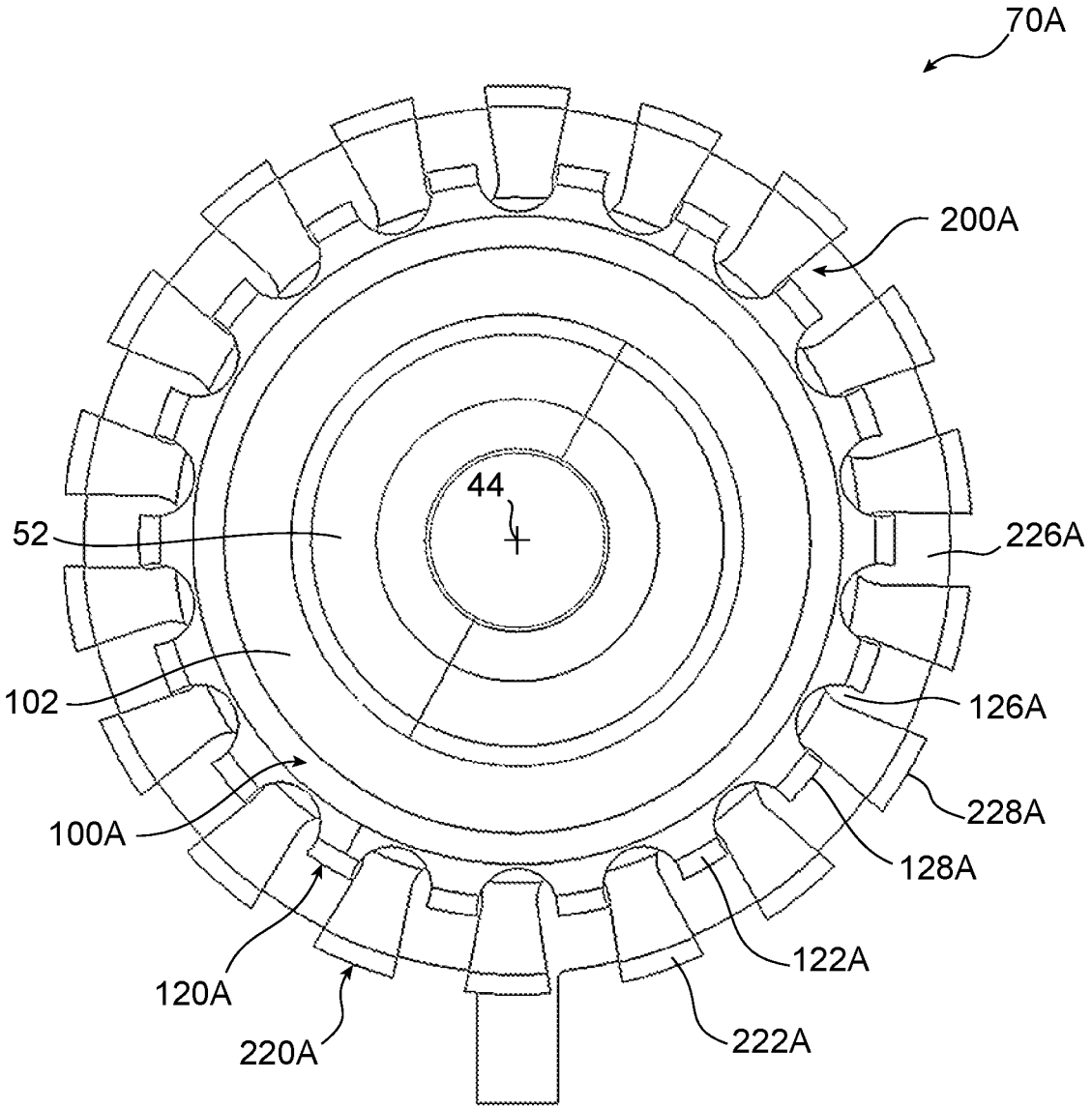

FIGS. 6 and 7 illustrate an injection system 70A broadly similar to the injection system 70 described above, but in which the first and second air intake swirlers 100A, 200A differ from the swirlers 100, 200 described above, because each of their respective aerodynamic deflectors 120A, 220A includes recesses 126A, 226A formed in its free end 122A, 222A. These recesses 126A, 226A delimit between them teeth 128A, 228A respectively arranged facing the respective inlets 110, 210 of the air inlet channels 108, 208.

The teeth 128A of the aerodynamic deflector 120A of the first air intake swirler 100A are advantageously angularly offset with respect to the teeth 228A of the aerodynamic deflector 220A of the second air intake swirler 200A, such that each tooth 128A is arranged axially facing a corresponding recess 226A.

The recesses 126A of the aerodynamic deflector 120A of the first air intake swirler 100A thus let extra air pass towards the second air intake swirler 200A.

Alternatively, an injection system according to the invention can include a single air intake swirler, or even a first air intake swirler in accordance with the second embodiment described above and a second air intake swirler in accordance with the first embodiment described above, or vice versa.

Figure 8:
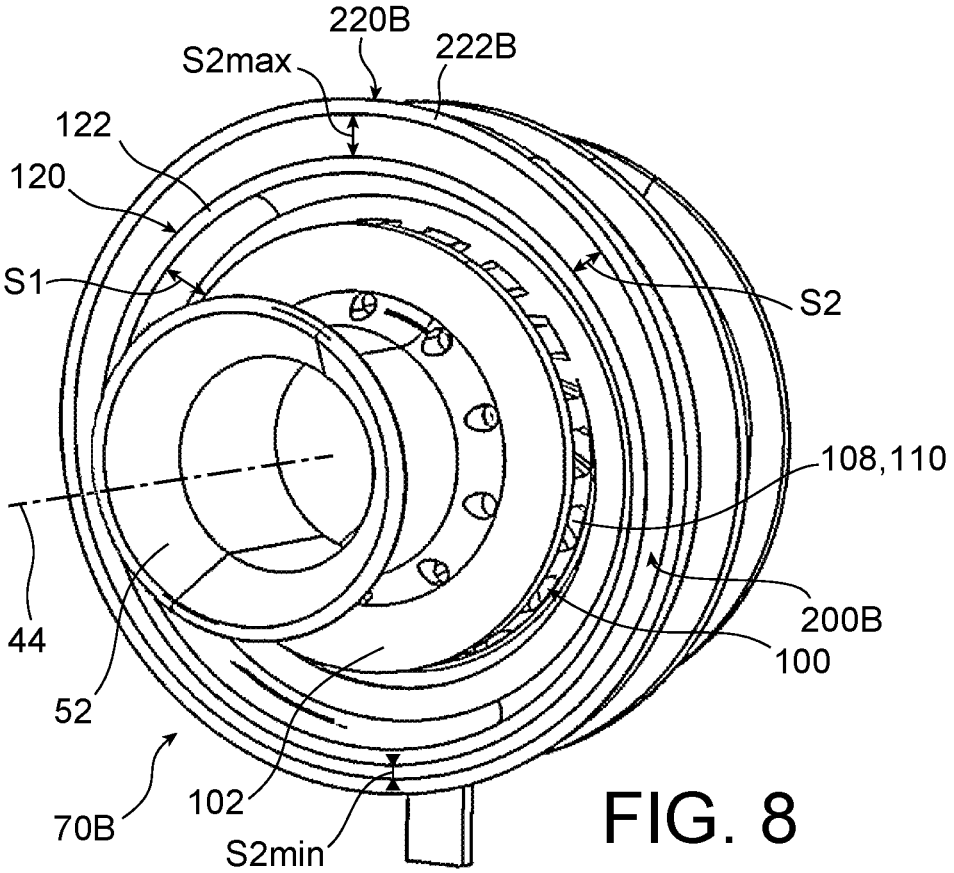
FIGS. 8 to 11 are perspective schematic views of injection systems according to other preferred embodiments of the invention.

FIG. 8 illustrates an injection system 70B broadly similar to the injection system 70 described above, but in which the aerodynamic deflector 220B of the second air intake swirler 200B is shaped such that the radial extent S2 of the air inlet section of said air intake swirler 200B varies about the axis 44.

In the example illustrated in FIG. 8, the aerodynamic deflector 220B is in particular shaped such that its free end 222B is of a circular shape and is off-centred with respect to the axis 44. The free end 222B is for example off-centred from the axis 44 in a direction oriented radially outwardly with respect to the axis 28 of the combustion chamber (visible in FIG. 2).

The radial extent S2 has preferably a minimum value S2min equal to half a nominal value corresponding to the radial extent that a section which would be equivalent but with a constant radial extent would have (as in FIGS. 4 and 5). Moreover, the radial extent S2 has preferably a maximum value S2max equal to triple the nominal value.

Alternatively, the variability of the radial extent S2 of the air inlet section can be obtained by a non-axisymmetric shape of the aerodynamic deflector 220B, for example an off-centred oval shape.

Alternatively or complementarily, the aerodynamic deflector of the first air intake swirler can assume a configuration such that the radial extent S1 of the air inlet section of the first air intake swirler varies about the axis 44.

Generally, the variability of the radial extent of the air inlet section of at least one of the air intake swirlers enables homogeneity in supplying this swirler with air to be homogenised in view of various design parameters of the turbomachine, including in particular the possible flow heterogeneity at the outlet of the compressor 16, the slipstream induced by the injector arm 55 in the airflow supplying the injection system 70B, and the influence of the protective annular fairing 45 on the aforementioned airflow.

Figure 9:
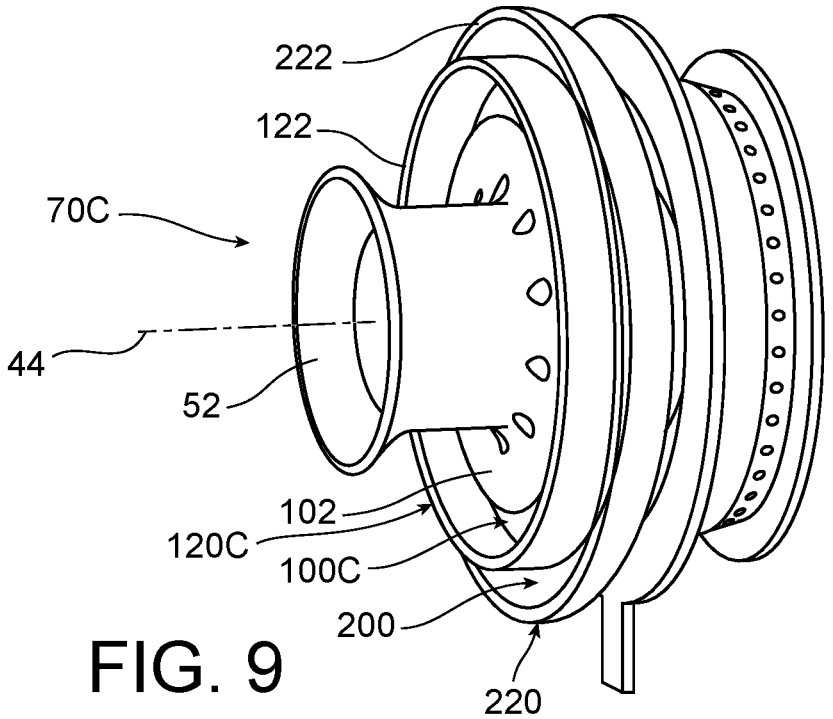
Figure 10:
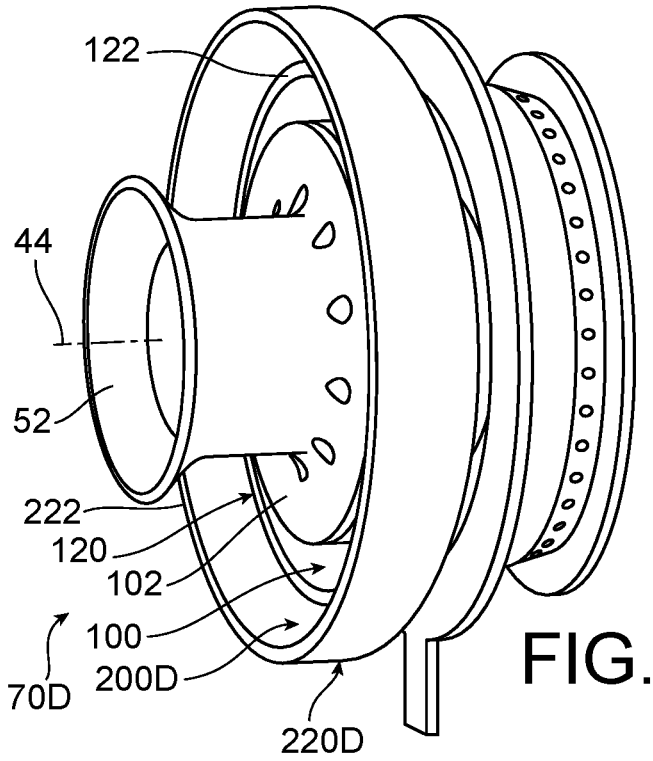
Figure 11:
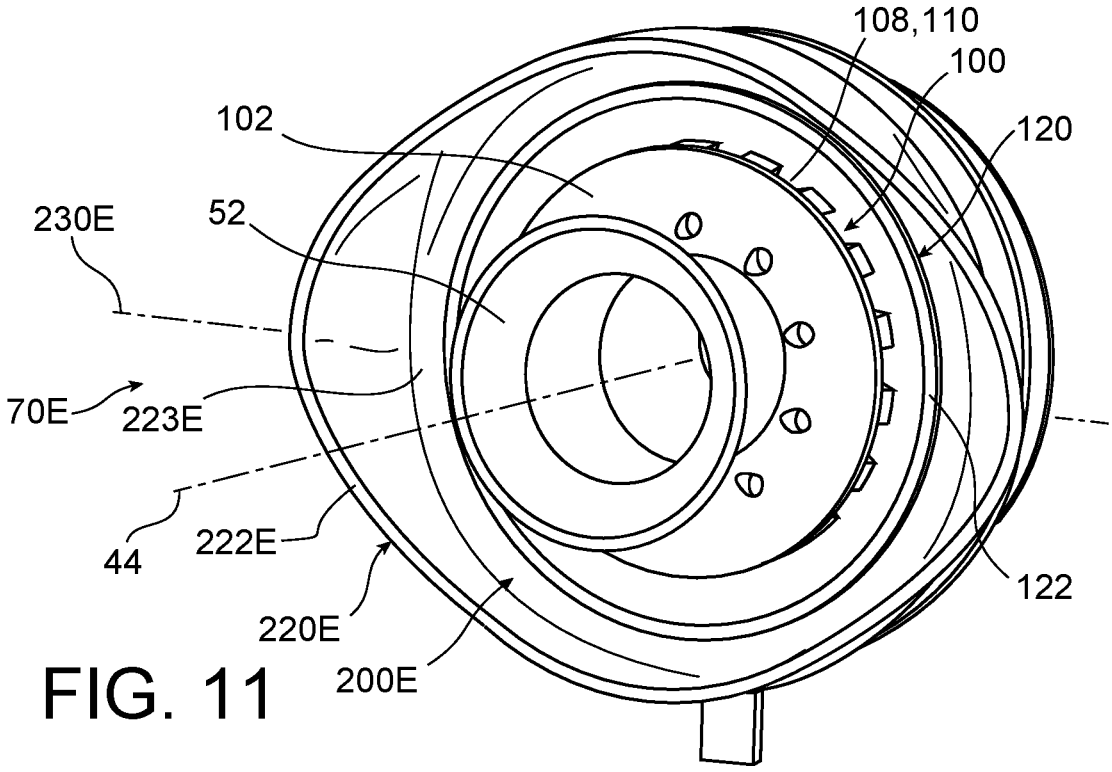

Other alternatives enable supply of the air intake swirlers with air to be optimised depending on such parameters, as shown in FIGS. 9 to 11.

FIGS. 9 and 10 respectively illustrate injection systems 70C and 70D broadly similar to the injection system 70 described above, but in which the respective free ends of the respective aerodynamic deflectors of the first and second air intake swirlers are offset with respect to each other along the direction of the axis 44.

Thus, in the embodiment of FIG. 9, the aerodynamic deflector 120C of the first air intake swirler 100C extends upstream beyond the free end 222 of the aerodynamic deflector 220 of the second air intake swirler 200.

Reversely, in the embodiment of FIG. 10, the aerodynamic deflector 220D of the second air intake swirler 200D extends upstream beyond the free end 122 of the aerodynamic deflector 120 of the first air intake swirler 100.

Finally, FIG. 11 illustrates an injection system 70E similar to that of FIG. 10, except that the aerodynamic deflector 220E of the second air intake swirler 200E has an oval or oblong free end 222E, extending for example from a circular section annular portion 223E of the deflector.

In the example illustrated, the major axis 230E of the free end 222E is oriented along a circumferential direction defined with respect to the axis 28 of the combustion chamber (visible in FIG. 2).

The shape of the free end 222E makes it possible to achieve a variability in the radial extent of the air inlet section of the second air intake swirler 200E about the axis 44, analogously to what has been described in reference to FIG. 8.

The invention claimed is:

1. An injection system for injecting an air and fuel mixture in a turbomachine combustion chamber, comprising:

a sleeve for centering an injector;

a bowl;

a first air intake swirler axially arranged between the sleeve and the bowl; and a second air intake swirler axially arranged between the first air intake swirler and the bowl, each of the first and second air intake swirlers comprising an upstream wall and a downstream wall along a flow direction of gas primary flow, both the upstream wall and the downstream wall being of revolution about an axis of the air intake swirler, and fins distributed about the axis and connecting the upstream wall to the downstream wall so as to delimit between the downstream and upstream walls air inlet channels each having an inlet arranged on a radially outer side and an outlet arranged on a radially inner side, wherein the downstream wall of the first air intake swirler is the upstream wall of the second air intake swirler, wherein each of the first and second air intake swirlers further includes a respective aerodynamic deflector which is an outwardly radial extension of the downstream wall of the corresponding air intake swirler and is terminated with a free end, each respective aerodynamic deflector having a concavity pointing upstream along the flow direction of the gas primary flow such that the aerodynamic deflector extends radially facing the respective inlets of the air inlet channels of the corresponding air intake swirler, and wherein at least one of the respective aerodynamic deflectors of the first and second air intake swirlers is shaped such that a radial extent of an air inlet section of the corresponding air intake swirler varies about the axis.

2. The injection system according to claim 1, wherein the aerodynamic deflector of at least one of the first and second air intake swirlers continuously extends over 360 degrees about the axis, from the downstream wall to the free end of the aerodynamic deflector.

3. The injection system according to claim 1, wherein the aerodynamic deflector of at least one of the first and second air intake swirlers includes recesses formed in the free end of the aerodynamic deflector so as to delimit therebetween teeth respectively arranged facing the respective inlets of the air inlet channels of the corresponding air intake swirler.

4. The injection system according to claim 1, wherein the upstream and downstream walls of each of the first and second air intake swirlers substantially extend orthogonally to the axis.

5. The injection system according to claim 1, wherein the aerodynamic deflector of each of the first and second air intake swirlers is shaped such that at each point of the free end of the aerodynamic deflector, a circumferential plane tangent to a radially inner edge of the free end is substantially parallel to the axis.

6. The injection system according to claim 1, further comprising an inner deflection annular wall having an inner profile with a convergent-divergent shape, which is an extension of the downstream wall of the first air intake swirler inwardly of the injection system.

7. The injection system according to claim 1, wherein the respective free ends of the respective aerodynamic deflectors of the first and second air intake swirlers substantially extend in a same transverse plane.

8. The injection system according to claim 7, wherein the upstream wall of the first air intake swirler extends in the same transverse plane.

9. The injection system according to claim 1, wherein the respective free ends of the respective aerodynamic deflectors of the first and second air intake swirlers are offset with respect to each other along the direction of the axis.

10. An aircraft turbomachine, comprising a combustion chamber and at least one injection system according to claim 1 for supplying the combustion chamber with an air and fuel mixture.

11. The injection system according to claim 1, wherein the at least one of the respective aerodynamic deflectors of the first and second air intake swirlers is shaped such that the free end thereof is of a circular shape and is off-centered with respect to the axis.

12. The injection system according to claim 1, wherein the at least one of the respective aerodynamic deflectors of the first and second air intake swirlers has a non-axisymmetric shape providing variability of the radial extent of the air inlet section of the corresponding air intake swirler about the axis.

* * * * *